US009614326B2

(12) United States Patent
Saito et al.

(10) Patent No.: US 9,614,326 B2
(45) Date of Patent: Apr. 4, 2017

(54) CONNECTING STRUCTURE OF TERMINAL

(71) Applicant: YAZAKI CORPORATION, Tokyo (JP)

(72) Inventors: Masayuki Saito, Shizuoka (JP); Takashi Muro, Shizuoka (JP); Hiroshi Kobayashi, Aichi (JP); Masao Nagano, Aichi (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/459,311

(22) Filed: Aug. 13, 2014

(65) Prior Publication Data

US 2014/0357110 A1 Dec. 4, 2014

Related U.S. Application Data

(63) Continuation of application No. PCT/JP2013/059430, filed on Mar. 22, 2013.

(30) Foreign Application Priority Data

Mar. 23, 2012 (JP) ..... 2012-068167

(51) Int. Cl.
*H01R 13/639* (2006.01)
*H01R 13/11* (2006.01)
(Continued)

(52) U.S. Cl.
CPC ..... *H01R 13/639* (2013.01); *H01R 13/113* (2013.01); *H01R 13/428* (2013.01); *H01R 13/746* (2013.01)

(58) Field of Classification Search
CPC ..... H01R 13/434; H01R 13/639
(Continued)

(56) References Cited

U.S. PATENT DOCUMENTS 5,722,925 A * 3/1998 Kameyama ..... H01R 13/113 600/453
6,039,615 A * 3/2000 Suzuki ..... H01R 13/113 439/849
(Continued)

FOREIGN PATENT DOCUMENTS

CN 101340039 A 1/2009
JP 11-329569 A 11/1999

OTHER PUBLICATIONS

International Search Report and Written Opinion of the International Search Report for PCT/JP2013/059430 dated Jun. 26, 2013.
(Continued)

*Primary Examiner* — Renee Luebke
*Assistant Examiner* — Paul Baillargeon
(74) *Attorney, Agent, or Firm* — Kenealy Vaidya LLP

(57) ABSTRACT

In a connecting structure of a terminal configured to connect a female terminal inserted into a terminal accommodating chamber to the male terminal, the female terminal comprises a tubular part made of a metal plate and formed into which the male terminal is inserted, a plate shaped engaging piece continued from a side wall of the tubular part and folded back so that the engaging piece is located in a path into which the male terminal is inserted, a notch formed on an outer side surface of a folded back part of the engaging piece. The male terminal is provided with a cut-out part which can accommodate the engaging piece, and the engaging piece is accommodated in the cut-out part when the female terminal is inserted to a set position to lock a movement of the female terminal in a pulling out direction.

3 Claims, 8 Drawing Sheets

(51) Int. Cl.
*H01R 13/428* (2006.01)
*H01R 13/74* (2006.01)

(58) Field of Classification Search
USPC ..... 439/852, 889, 748, 301, 345, 346, 350, 439/357
See application file for complete search history.

(56) References Cited

U.S. PATENT DOCUMENTS

2005/0085139 A1 4/2005 Copper et al.
2008/0311779 A1 12/2008 Brassell et al.

OTHER PUBLICATIONS

Chinese Office Action for the related Chinese Patent Application No. 201380015717.7 dated Nov. 24, 2015.

* cited by examiner

CONNECTING STRUCTURE OF TERMINAL

CROSS REFERENCE TO RELATED APPLICATIONS

This application is a continuation of PCT application No. PCT/JP2013/059430, which was filed on Mar. 22, 2013 based on Japanese Patent Application (No. 2012-068167) filed on Mar. 23, 2012, the contents of which are incorporated herein by reference.

BACKGROUND OF THE INVENTION

1. Field of the Invention

The present invention relates to a connecting structure of a terminal.

2. Description of the Related Art

Usually, as a waterproof structure of a joint connector, for instance, a technique disclosed in PTL1 is known.

FIG. 9 shows a waterproof structure of a joint connector of the PTL1. Inside a tubular body 73 of a housing 71, a terminal accommodating chamber 79 into which a female terminal 77 having an electric wire 75 connected thereto is inserted, is formed. In the terminal accommodating chamber 79, a male terminal 81 is accommodated. The male terminal 81 has one end side fixed to a base part 83 in a back side of the terminal accommodating chamber 79 and the other end side extending in the axial direction of the terminal accommodating chamber 79. At a position near the other end of the male terminal 81, a lock hole 85 is provided to pass through the male terminal 81.

In the female terminal 77, a tubular part 87 into which the male terminal 81 can be inserted is formed in its end part of the female terminal 77, by bending a metal plate. In the tubular part 87, a resilient contact piece 89 which can be resiliently deformed is formed, by folding back a front end edge inside. The resilient contact piece 89 can be allowed to come into contact with the male terminal 81 inserted into the tubular part 87 under a prescribed contact pressure. The resilient contact piece 89 has a moderate mountain-shaped configuration having a swelling central part and a protruding part 91 formed in a top part of the resilient contact piece 89 which can be engaged with the lock hole 85. The protruding part 91 is formed by cutting upward the top part of the resilient contact piece 89.

In a rear part of the tubular part 87, a crimping part 93 is formed to crimp the electric wire 75 as to envelop the electric wire 75. In the crimping part 93, core wires exposed from a cover of the electric wire 75 are crimped. In the vicinity of an end of the cover part of the electric wire 75, a rubber plug 95 is attached. An outer peripheral surface of the rubber plug 95 is allowed to come into close contact with an inner peripheral surface of the terminal accommodating chamber 79. Thus, water is prevented from entering the terminal accommodating chamber 79.

When the female terminal 77 is inserted into the terminal accommodating chamber 79 of the housing 71 configured in such a way, the male terminal 81 bends the resilient contact piece 89 and is fitted to the tubular part 87. Then, when the female terminal 77 is inserted to a set position of the terminal accommodating chamber 79, the lock hole 85 is engaged with the protruding part 91 to prevent the female terminal from slipping out. In the housing 71, the female terminal 77 and the male terminal 81 are short-circuited.

CITATION LIST

Patent Literature

[PTL1] JP-A-11-329569

SUMMARY OF THE INVENTION

In a joint connector mounted on a vehicle, for instance, when the vehicle is overhauled and recycled, an electric wire is detached from housing. At this time, in a terminal connecting structure disclosed in the PTL1, since the female terminal is engaged with the male terminal by the protruding part and the lock hole, when the electric wire is pulled out from the housing, the female terminal is not sometimes disengaged from the male terminal and stays in the terminal accommodating chamber. In this case, there is possibility in that that a recovery percentage is lowered.

It is an object of the present invention to improve a recovery percentage of a terminal when an electric wire is detached from housing.

In order to achieve the object, the present invention provides with a connecting structure of a terminal, comprising a housing made of a resin and including a terminal accommodating chamber formed into which a female terminal connected to an electric wire is inserted, and a plate shaped male terminal fixed to the terminal accommodating chamber, and configured to connect the female terminal inserted into the terminal accommodating chamber to the male terminal, the female terminal comprising a tubular part made of a metal plate and formed into which the male terminal is inserted, a plate shaped engaging piece continued from a side wall of the tubular part and folded back so that the engaging piece is located in a path into which the male terminal is inserted, a notch formed on an outer side surface of a folded back part of the engaging piece; wherein the male terminal is provided with a cut-out part which can accommodate the engaging piece, and the engaging piece is accommodated in the cut-out part when the female terminal is inserted to a set position to lock a movement of the female terminal in a pulling out direction.

According to the structure, when the female terminal is inserted into the terminal accommodating chamber, the male terminal is inserted into the tubular part by bending the engaging piece of the tubular part of the female terminal. Then, when the female terminal is inserted to the set position of the terminal accommodating chamber, the engaging piece of the female terminal is accommodated in the cut-out part of the male terminal, so that the male terminal is engaged with the female terminal. Thus, a movement of the female terminal in a pulling out direction is locked.

Then, under a state that the movement of the female terminal in the pulling out direction is locked, when the electric wire connected to the female terminal is pulled, the female terminal moves in the pulling out direction from the terminal accommodating chamber while the engaging piece is accommodated in the cut-out part of the male terminal. Thus, the end part of the engaging piece moves in a circumferential direction on the folded back part as a center. Accordingly, a cut groove of the notch which is formed in the folded back part is gradually narrowed. Then, when the end part of the engaging piece presses the cut-out part, the folded back part receives a reaction force from the cut-out part. As a result, a crack is formed in the notch to break the folded back part. When the folded back part is broken in such a way, since an engaged state of the engaging piece and the cut-out part is released, the female terminal can be easily pulled out from the terminal accommodating chamber. Accordingly, a recovery percentage of the terminal can be improved.

Further, the cut out part can be provided with a hook shaped recessed part for accommodating an end part of the engaging piece.

According to the structure, when a force for pulling out the female terminal from the terminal accommodating chamber to the female terminal, since the end of the engaging piece is accommodated in the recessed part, the engaging piece can be prevented from simply disengaging from the cut-out part. On the other hand, when the female terminal moves in the pulling out direction under a state that the end of the engaging piece is accommodated in the recessed part, a stress is liable to be concentrated on the folded back part. Thus, the folded part can be more assuredly broken.

Further, a support member for attaching the housing to a member to be attached may be connected to the housing, a bolt attaching hole fixing the support member to the member to be attached may be formed in the support member and the bolt attaching hole may be provided at a position shifted to an opposite side to the cut out part of the male terminal with respect to an axis of the male terminal.

According to the structure, to the female terminal pulled out from the terminal accommodating chamber, a force in the pulling out direction is applied by setting the bolt attaching hole as a cardinal point. Namely, the female terminal is inclined and pulled out in a direction opposite to the bolt attaching hole with respect to the axis of the terminal accommodating chamber (an arrow mark E in FIG. 7B). Thus, since the engaging piece can smoothly move in the circumferential direction on the folded back part as the center, the folded back part can be more assuredly broken.

According to the present invention, a recovery percentage of a terminal can be improved when an electric wire is detached from housing.

DETAILED DESCRIPTION OF THE EXEMPLARY EMBODIMENTS

Now, an embodiment of a connecting structure of a terminal according to the present invention will be described below. In the present embodiment, the connecting structure of the terminal as a waterproof connector is described. However, the present invention is not limited to this embodiment.

Figure 1:
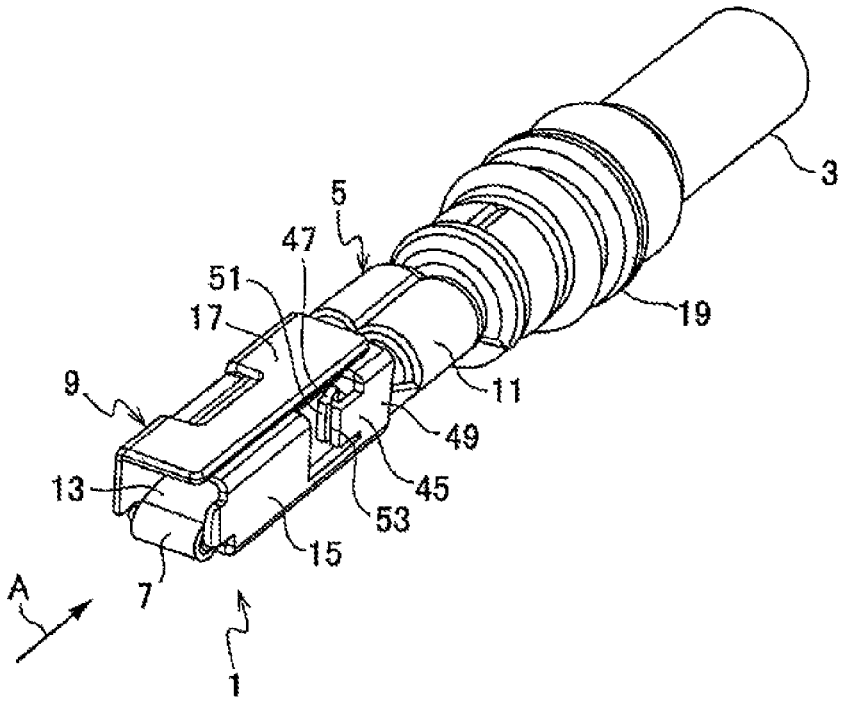
FIG. 1 is a perspective view of a male terminal in a connecting structure of a terminal to which the present invention is applied.

FIG. 1 shows a state that an electric wire 3 is connected to a female terminal 1 of the present embodiment. The female terminal 1 of the present embodiment includes a crimping part 5, a resilient tongue piece 7 and a tubular part 9, and is formed by applying, for instance, a necessary bending work to a terminal piece obtained by applying a punching work to a thin metal plate.

The crimping part 5 has a function for crimping and connecting the electric wire 3 to crimp core wires (not shown in the drawing) exposed from a cover of the electric wire 3 so as to envelop the core wires by one pair of crimping pieces 11.

The tubular part 9 which extends in an axial direction with the crimping part 5 set as a base part is bent substantially in a rectangular tubular shape to form a space 13 into which a mate side terminal (a male terminal) is inserted in the axial direction. In the tubular part 9, both end side of a bottom surface extending in the axial direction are respectively bent substantially at right angles to the bottom surface to form side walls 15. Bent end sides of the one pair of side walls 15 are bent substantially at right angles thereto so as to overlap one another. Thus, a top surface 17 is formed. An arrow mark A in FIG. 1 shows an inserting direction of the male terminal.

Further, the resilient tongue piece 7 is extended from an inserting side edge of the male terminal in one surface (the bottom surface) of the tubular part 9 and folded back to the space 13. Accordingly, the resilient tongue piece 7 can be resiliently deformed on a bent part of the folded back part as a supporting point to press the male terminal inserted into the space 13 toward a direction (the top surface 17 side) opposed to the one surface of the tubular part 9 to sandwich the male terminal between them.

On the other hand, in the electric wire 3 crimped to the crimping part 5, an annular packing 19 as a seal member is attached to an outer peripheral surface of a covered part near an end (the crimping part 5 side). The packing 19 allows the female terminal 1 to come into close contact with an inner wall surface of an inlet part of a terminal accommodating chamber over an entire circumference when the female terminal 1 is inserted into the terminal accommodating chamber of a below-described housing.

Figure 2:
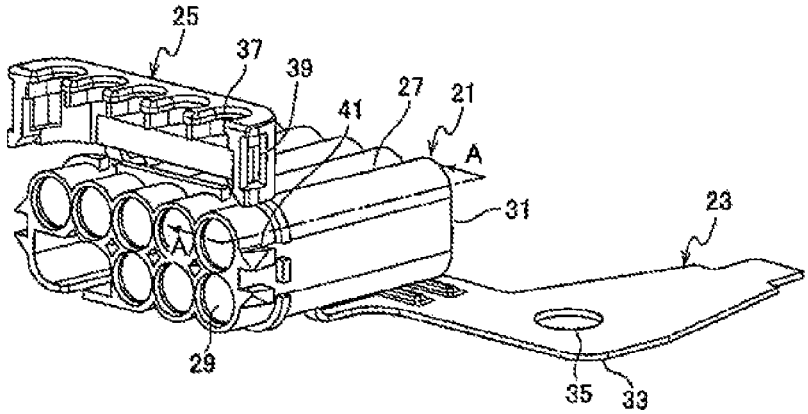
FIG. 2 is a perspective view showing a state that a rear cover of housing is opened in the connecting structure of the terminal to which the present invention is applied.
Figure 3:
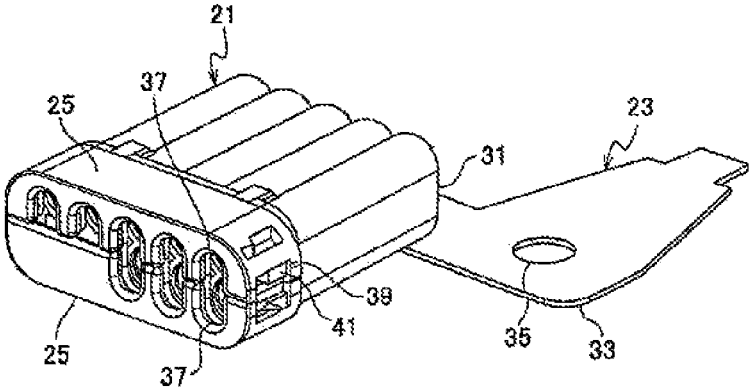
FIG. 3 is a perspective view showing a state that the rear cover of the housing is closed in the connecting structure of the terminal to which the present invention is applied.

Now, a structure of the housing will be described below. As shown in FIG. 2, the housing 21 of the present embodiment is formed by molding a synthetic resin and a support member 23 for attaching the housing 21 to a member to be attached which is not shown in the drawing is attached by an insert molding. To the housing 21, a pair of rear covers 25, are attached so as to freely rotate. FIG. 2 shows a state that one of the rear covers 25 is opened and the other is omitted. FIG. 3 shows a state that the one pair of rear covers 25 are rotated and closed.

The housing 21 is formed such that a plurality of tubular bodies 27 configured in cylindrical forms are arranged respectively in parallel. Inside the tubular body 27, the terminal accommodating chamber 29 is formed into which the female terminal 1 is inserted. An interior side in an inserting direction of the female terminal 1 is closed by a base part 31 and an inlet forms an opened cylindrical space.

The support member 23 is exposed from a bottom part (a lower part in FIG. 2) of the housing 21, extended toward the base part 31 side of the tubular body 27 in the axial direction, then, changes a direction substantially at right angles thereto to extend outside from a projection area (a projection area seen from an upper part of FIG. 2) in a planar direction of the housing 21 and further changes a direction substantially at right angles thereto in the shape of a crank. Further, in the support part 23, a bolt attaching hole 35 is formed to fix the support member 23 to the member to be attached at an angular part 33 where the direction is changed substantially at right angles outside the projection area of the housing 21.

In the housing 21, the one pair of rear covers 25 are attached to an outer peripheral wall near the opening of the tubular body 27 so as to freely rotate. As shown in FIG. 3, in the rear cover 25, an electric wire insert groove 37 is provided which is formed in a semicircular arc shape to accommodate the electric wire 3 led out from the terminal accommodating chamber 29 of each of the tubular bodies 27. When the one pair of rear covers 25 are respectively rotated and closed, the electric wires 3 are respectively accommodated one by one in their electric wire insert grooves 37. Further, in the housing 21, engaging protrusions 41 are provided which are engaged with engaging holes 39 formed in the rear covers 25.

Figure 4:
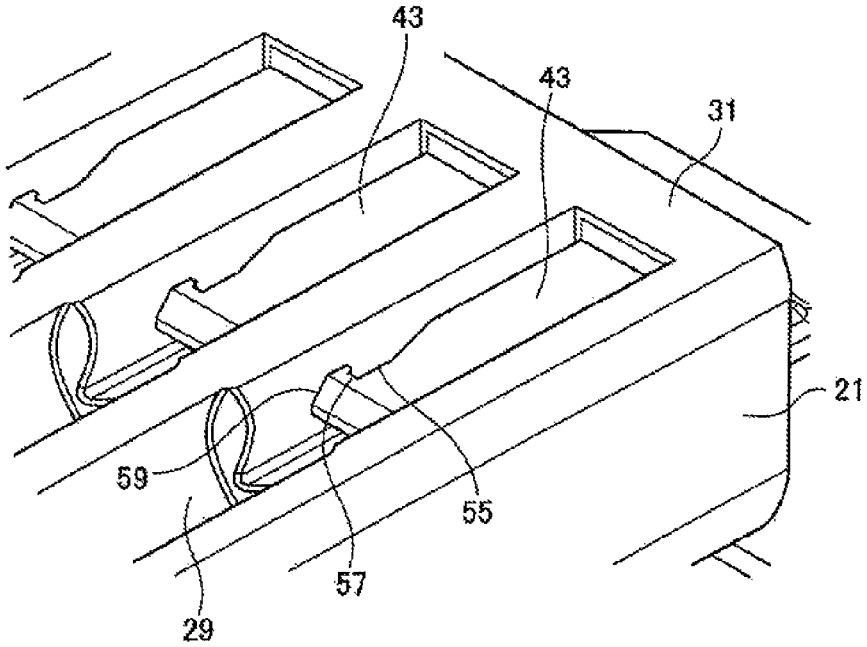
FIG. 4 is a sectional view seen in a direction shown by a line A-A in FIG. 2.

Now, a structure of the terminal accommodating chamber 29 of the housing 21 will be described below. As shown in FIG. 4, in the terminal accommodating chamber 29, a male terminal 43 is accommodated which has a base end side (a right upper part in FIG. 4) embedded in the base part 31 by an insert molding and is extended coaxially with the terminal accommodating chamber 29. The male terminal 43 is formed with a metal plate material of a rectangular shape. An end side of the male terminal (a left lower part in FIG. 4) is arranged substantially at a central position in a longitudinal direction (an axial direction) of the terminal accommodating chamber 29. A dimension of the male terminal 43 in the direction of width (a transverse direction) is set to be smaller than a dimension of an inside diameter of the terminal accommodating chamber 29. Both side edges of the male terminal extending in the longitudinal direction are arranged with set spaces left from inner side walls of the terminal accommodating chamber 29. More specifically, the dimension of the male terminal 43 in the direction of width is set such a size as to be accommodated in the space 13 of the tubular part 9 of the female terminal 1.

Now, characteristic structures of the present embodiment will be described below. In the present embodiment, the female terminal 1 and the male terminal 43 respectively have the characteristic structures.

As shown in FIG. 1, in the female terminal 1 of the present embodiment, a plate shaped support piece part 45 formed by cutting out the side wall 15 of the tubular part 9 is folded back to the space 13 side to form a plate shaped engaging piece 47. The plate shaped support part 45 is continued from the side wall 15. Specifically, the one side wall 15 of the one pair of side walls 15 connected to a base end 49 of the end side in the inserting direction (the arrow mark A) of the male terminal 43 is cut out to form the rectangular support piece part 45. Then, an end side (an opposite side to the base end 49) of the support piece part 45 is located in a path of the space 13 to which the male terminal 43 is inserted to form the engaging piece 47. On an outer side surface of a folded back part 51 located between the engaging piece 47 and the support piece part 45, a notch 53 having a groove of a V shaped section is formed over a direction of width of a plate. The form of the groove of the notch 53 preferably has a shape of V, however, may have a shape of U.

On the other hand, as shown in FIG. 4, in the male terminal 43 of the present embodiment, a cut-out part 55 which can accommodate the engaging piece 47 is formed in one side edge extending in the longitudinal direction thereof. The cut-out part 55 has, when the male terminal 43 is seen from a planar direction, a bottom surface extending substantially in parallel with an axial direction of the male terminal 43. A smooth inclined surface is formed so as to be connected to one side of the bottom surface and a right angled surface is formed so as to intersect substantially at right angles to the other side of the bottom surface. In the right angled surface, a hook shaped recessed part 57 is formed which can accommodate a folded back end part of the engaging piece 47. Further, in the end part in the inserting direction of the male terminal 43, a tapered surface 59 is formed respectively in a planar direction and a direction of thickness.

Now, an operation of the connecting structure formed in such a way will be described below.

Figure 5B:
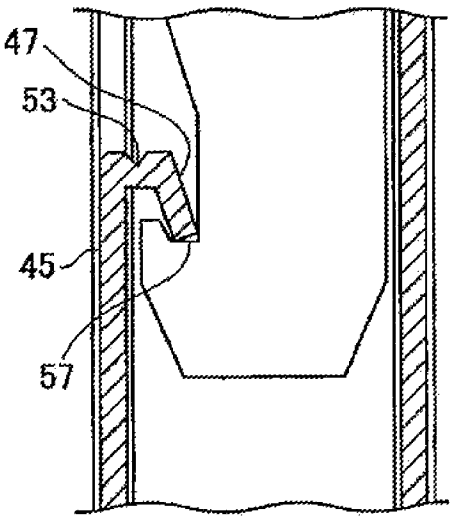
FIGS. 5A and 5B are diagrams for explaining an operation when a female terminal is inserted into a terminal accommodating chamber.
Figure 5A:
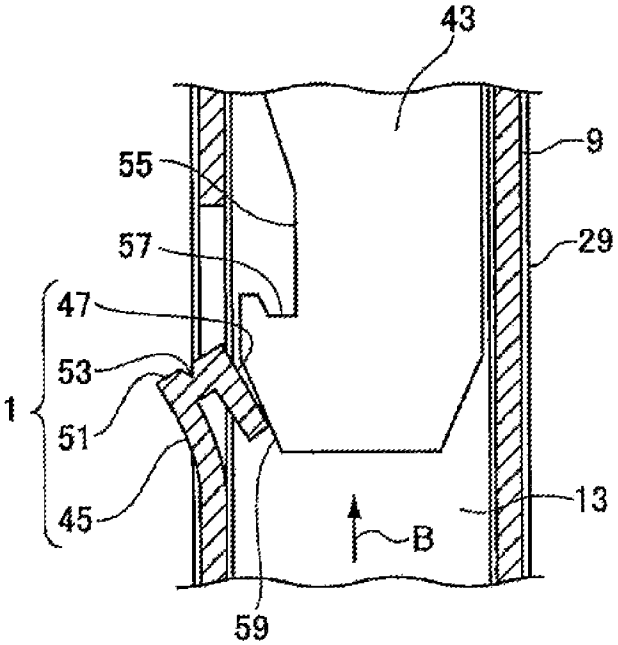

Initially, as shown in FIG. 5A, when the female terminal 1 is inserted into the terminal accommodating chamber 29 in a direction shown by an arrow mark B, the male terminal 43 is inserted to the tubular part 9 of the female terminal 1. At this time, since the engaging piece 47 is arranged in an inserting path of the male terminal 43 in the tubular part 9, the male terminal 43 initially pushes the engaging piece 47 outside the space 13 along the tapered surface 59. Subsequently, the male terminal 43 enters by bending the folded back part 51 or the support piece part 45 connected to the engaging piece 47 outside the space 13. Then, when the female terminal 1 is inserted to a set position of the terminal accommodating chamber 29, as shown in FIG. 5B, in the female terminal 1, the end part of the engaging piece 47 is accommodated in the cut-out part 55 of the male terminal 43 by a restoring force of a resilient deformation, so that the male terminal 43 is engaged with the female terminal 1. Thus, a movement of the female terminal 1 in a pulling out direction is locked. Further, the male terminal 43 is electrically connected to the female terminal 1 through the engaging piece 47. However, the electric connection of the male terminal 43 and the female terminal 1 can be basically obtained by pressing the male terminal 43 to the top surface 17 through the resilient tongue piece 7 in the tubular part 9.

Figure 6:
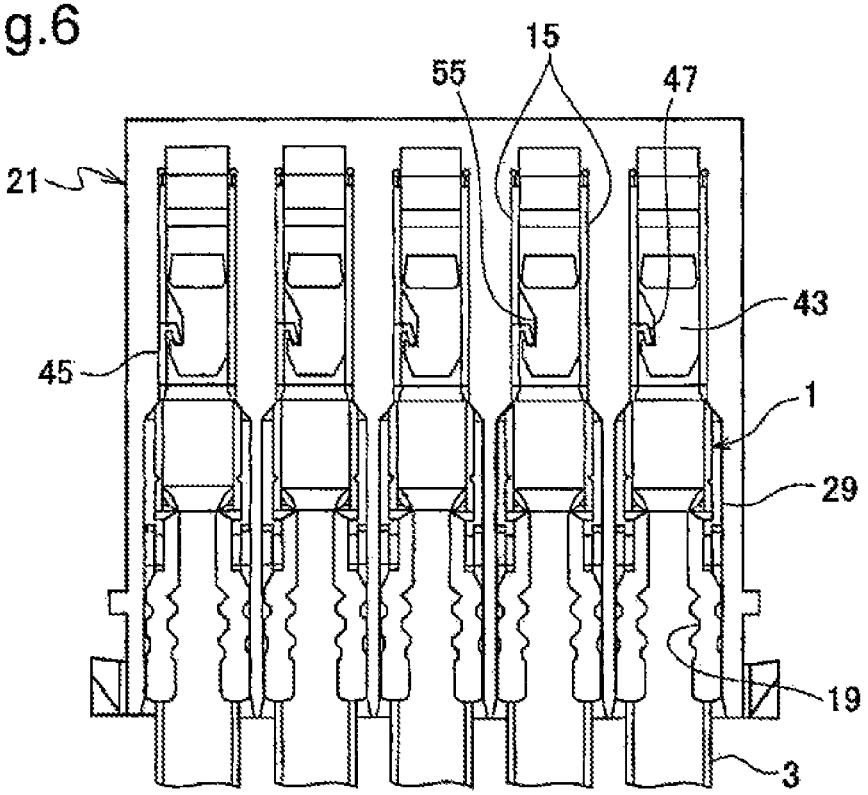
FIG. 6 is a sectional view of the connecting structure of the terminal to which the present invention is applied.

FIG. 6 shows a state that the female terminal 1 inserted into the terminal accommodating chamber 29 is engaged with the male terminal 43. In this example, since the electric wire 3 to which the packing 19 is attached is inserted to the terminal accommodating chamber 29, an outer peripheral surface of the packing 19 comes into close contact with the inner peripheral surface of the inlet side of the terminal accommodating chamber 29 over the entire circumference. Thus, since a gap between electric wire 3 and the inner wall surface of the terminal accommodating chamber 29 is airtightly sealed, water can be prevented from entering a terminal connecting part of the terminal accommodating chamber 29.

Figure 7B:
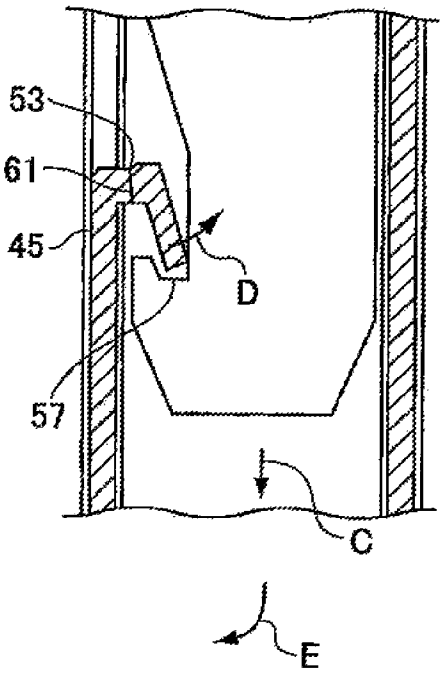
FIGS. 7A and 7B are diagrams for explaining an operation when the female terminal is pulled out from the terminal accommodating chamber.
Figure 7A:
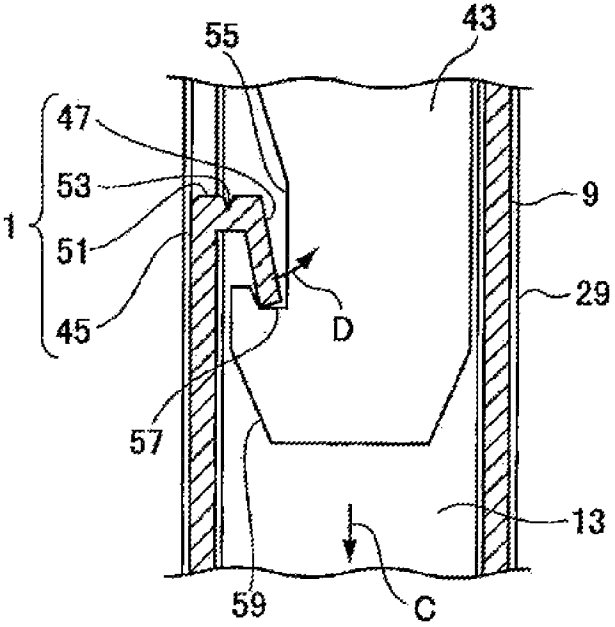

Then, as shown in FIG. 7A, under a state that the movement of the female terminal 1 in the pulling out direction is suppressed, when the electric wire 3 connected to the female terminal 1 is pulled from the terminal accommodating chamber 29 in a direction shown by an arrow mark C, in the female terminal 1, the end part of the engaging piece 47 moves in the pulling out direction while the end part of the engaging piece 47 is accommodated in the recessed part 57 of the cut-out part 55. Thus, the end part of the engaging piece 47 moves in a circumferential direction (an arrow mark D) on the folded back part 51 as a center, namely, the engaging piece begins to rotate. In accordance with the circumferential movement of the engaging piece 47, a gap between two inclined surfaces forming the notch 53 which is formed in the folded back part 51 is gradually narrowed, and finally, the inclined surfaces come into close contact with each other. Then, as shown in FIG. 7B, when the end part of the engaging piece 47 presses the cut-out part of the male terminal 43 to the direction shown by the arrow mark D, the folded back part 51 receives a reaction force from the male terminal 43. As a result, a crack 61 is formed in the notch 53 to break the folded back part 51. When the folded back part 51 is broken in such a way, since an engaged state of the engaging piece 47 and the cut-out part 55 is released, the female terminal 1 can be easily pulled out from the terminal accommodating chamber 29. Accordingly, in the present embodiment, since a recovery percentage (a recycle percentage) of the female terminal 1 can be improved, the present invention is economical and can contribute to an environmental aspect.

Figure 8:
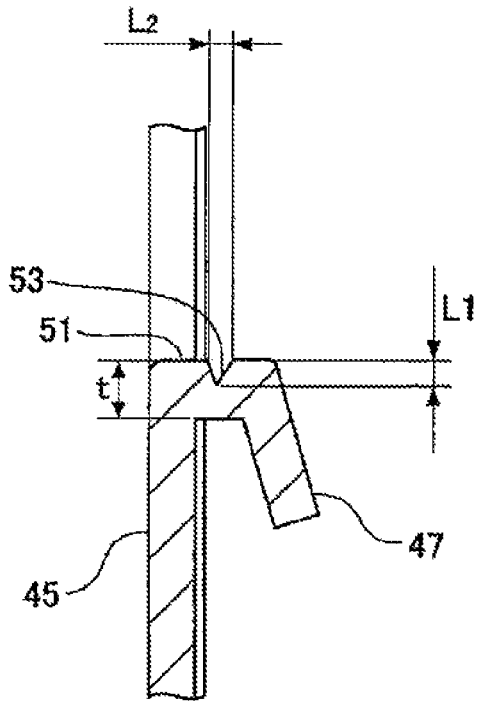
FIG. 8 is a diagram for explaining a dimension of a notch formed in a folding back part.
Figure 9:
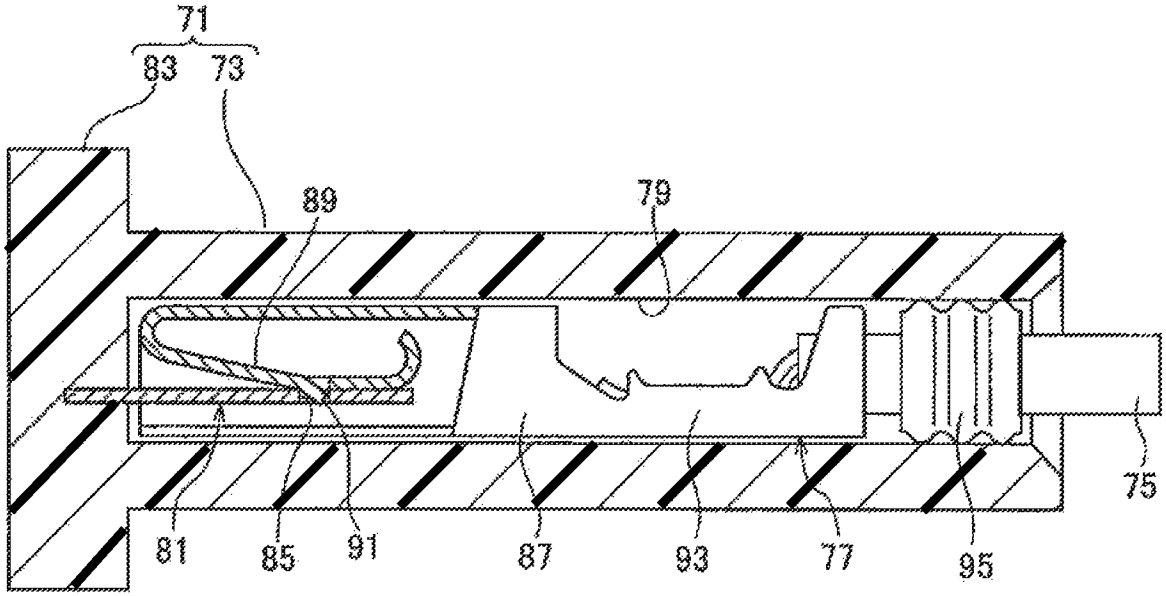
Fig.9 Related Art
FIG. 9 is a sectional view of a usual connecting structure of a terminal.

In FIG. 8, the notch 53 formed in the folded back part 51 of the female terminal 1 is enlarged to be shown. A dimension (a cutting depth $L_1$, a cutting width L) of the notch 53 is suitably set so that a resiliency of the engaging piece 47 may be ensured when the male terminal 43 is inserted into the tubular part 9 of the female terminal 1 and the two inclined surfaces forming the notch 53 of the engaging piece 47 may come into close contact with each other when the female terminal 1 is pulled out from the terminal accommodating chamber 29. It is desirable that, for instance, the cutting depth $L_1$ is set within a range half or smaller than a thickness t of the folded back part 51, and the cutting width $L_2$ is set within a range smaller than a space between an inner side surface of the side wall 15 of the tubular part 9 and the side edge of the male terminal 43 when the male terminal 43 is inserted into the tubular part 9.

In the present embodiment, since the one pair of rear covers 25 are attached to the housing 21, the electric wires 3 are respectively inserted to the electric wire insert grooves 37 of the one pair of rear covers 25 and the engaging protrusions 41 of the housing 21 are inserted to the engaging holes 39 of the rear covers 25 so that the rear covers 25 are engaged with the housing 21. Here, a dimension of an inside diameter of the electric wire insert groove 37 is suitably set (for instance, a lap setting) so as to meet a dimension of an outside diameter of the covered electric wire 3. Thus, even when the electric wire 3 receives such an external force as to swing the electric wire 3 right and left, a load (an influence of the external force) to the electric wire 3 inserted to the terminal accommodating chamber 29 can be reduced and a connecting state of the female terminal 1 and the male terminal 43 can be effectively maintained.

The housing 21 of the present embodiment is attached to the member to be attached of, for instance, a vehicle side through the support member 23. The support member 23 is fixed to the member to be attached by inserting a bolt into the bolt attaching hole 35. Here, as shown in FIG. 3, the bolt attaching hole 35 is provided at a position shifted in an opposite side to the cut-out part 55 of the male terminal 43 with respect to axes of all the terminal accommodating chambers 46, that is, axes of the male terminals 43.

Thus, to the female terminal 1 pulled out from the terminal accommodating chamber 29, a force in the pulling out directing is applied by setting the bolt attaching hole 35 as a cardinal point. Namely, the female terminal 1 is pulled out in a direction opposite to the bolt attaching hole 35 with respect to the axis of the terminal accommodating chamber 29, namely, so that the folded back part 51 is inclined in a direction separating from the cut out part 55 of the male terminal 43. Thus, the engaging piece 47 can smoothly move in the circumferential direction on the folded back part 51 as the center and more effectively break the folded back part 51. Accordingly, when the bolt attaching hole 35 is arranged (offset) to be separated in a prescribed direction from the housing 21 as described above, the recovery percentage (the recycle percentage) of the female terminal 1 can be assuredly improved.

The embodiment of the present invention is specifically described above by referring to the drawings, however, the above-described embodiment is merely an exemplification of the present invention. The present invention is not limited to the structure of the embodiment. It is to be understood that a change of a design made within a scope that does not deviate from the gist of the present invention may be included in the present invention.

For instance, in the present embodiment, an example is described that the bolt attaching hole 35 is provided in the angular part 33 of the support member 23. However, as long as the bolt attaching hole 35 is provided at a position shifted in an opposite side to the cut-out part 55 of the male terminal 43 with respect to the axes of all the male terminals 43, an installed position of the bolt attaching hole is not especially limited.

According to the present invention, a recovery percentage of a terminal can be improved when an electric wire is detached from housing.

What is claimed is:

1. A connecting structure of a terminal, comprising a housing made of a resin and including a terminal accommodating chamber formed into which a female terminal connected to an electric wire is inserted, and a plate shaped male terminal fixed to the terminal accommodating chamber, and configured to connect the female terminal inserted into the terminal accommodating chamber to the male terminal, the female terminal including:

a tubular part made of a metal plate and formed into which the male terminal is inserted;

a plate shaped engaging piece continued from a side wall of the tubular part and folded back so that the engaging piece is located in a path into which the male terminal is inserted;

a cut formed on an outer side surface of a folded back part of the engaging piece over a direction of a plate width of the engaging piece;

wherein the male terminal is provided with a cut-out part which can accommodate the engaging piece, and the engaging piece is accommodated in the cut-out part when the female terminal is inserted to a set position to lock a movement of the female terminal in a pulling out direction, and the folded back part has a first thickness adjacent to the cut and a second thickness at the cut that is less than the first thickness.

2. The connecting structure of a terminal according to claim 1, wherein the cut out part is provided with a hook shaped recessed part for accommodating an end part of the engaging piece.

3. The connecting structure of a terminal according to claim 1, further comprising a support member for attaching the housing to a member to be attached is connected to the housing, a bolt attaching hole fixing the support member to the member to be attached is formed in the support member and the bolt attaching hole is provided at a position shifted to an opposite side to the cut out part of the male terminal with respect to an axis of the male terminal.

* * * * *